United States Patent [19]

Saunders et al.

[11] 3,979,118

[45] Sept. 7, 1976

[54] MARKSMANSHIP TARGET INCLUDING PIVOTING TARGET ARMS

[75] Inventors: Charles A. Saunders; Thomas A. Saunders, both of Columbus, Nebr.

[73] Assignee: Saunders Archery Company, Columbus, Nebr.

[22] Filed: Oct. 20, 1975

[21] Appl. No.: 623,793

Related U.S. Application Data

[63] Continuation-in-part of Ser. No. 484,287, June 28, 1974, Pat. No. 3,915,454.

[52] U.S. Cl. ..... 273/102.1 R; 273/127 R; 273/DIG. 25; 273/102.1 B

[51] Int. Cl.[2] ..... A63B 71/02

[58] Field of Search ..... 273/95 R, 102 R, 102 S, 273/102.1 R, 102.1 C, 102.4, 127 R, 127 D, DIG. 25

[56] References Cited

UNITED STATES PATENTS

| | | | |
|---|---|---|---|
| 2,967,712 | 1/1961 | Breitenfeldt | 273/102.1 R |
| 3,036,834 | 5/1962 | Zalkind | 273/DIG. 25 |
| 3,814,429 | 6/1974 | Lienhard | 273/127 R |
| 3,915,454 | 10/1975 | Saunders | 273/127 R |

*Primary Examiner*—Richard J. Apley
*Assistant Examiner*—Marvin Siskind
*Attorney, Agent, or Firm*—Kegan, Kegan & Berkman

[57] ABSTRACT

A marksmanship target presenting a plurality of targets to view by competing marksmen. When a marksman's missile strikes a target on a side of a shield assigned to him, that target shifts to his opponent's side. Each target is provided with a cushion adapted to strike a plate, thereby damping movement and preventing rebound of the struck target. Each target is integrally formed with a narrow, forwardly extending lip and several annularly spaced, shock absorbing ribs secured to a marginal edge of the target and connecting the target to a support arm.

10 Claims, 6 Drawing Figures

MARKSMANSHIP TARGET INCLUDING PIVOTING TARGET ARMS

This application is a continuation-in-part of co-pending United States patent application, Ser. No. 484,287 filed June 28, 1974 and now U.S. Pat. No. 3,915,454, Oct. 28, 1975.

BACKGROUND OF THE INVENTION

This invention relates to missile targets used in contests between marksmen impelling missiles with slingshots, bows, air rifles and the like.

Several prior art targets produce a visible reaction when they are struck by missiles. However, most prior art targets suffer from disadvantages making them less than completely suitable for simultaneous competition between marksmen capable of impelling missiles in rapid succession and at high velocities.

SUMMARY OF THE INVENTION

A principal object of the present invention is to provide a target assembly suitable for simultaneous use by competing marksmen.

It is a related object of the invention to provide a target assembly including sets of target pairs responsive to missile impacts by shifting rapidly between rest positions on opposed lateral sides of a target standard, so that only one target of each target pair is visible at any given time.

Another object of the invention is to provide a target assembly having a plurality of targets affixed to support arms, in which the impacts of high velocity missiles are cushioned to prevent target rebound and to prolong the useful life of the assembly.

It is a further object of the invention to provide a target including shock absorbing ribs integrally molded into the target structure, thereby obviating any need for auxiliary shock absorbing structures interposed between the target and a target arm supporting the target.

Yet another object of the invention is to provide a target assembly having a pair of arms supported on a standard in which the arms are fixed relatively stable with respect to one another, without affecting sensitivity of the assembly to missile impacts.

DESCRIPTION OF THE PREFERRED EMBODIMENT

Figure 1:
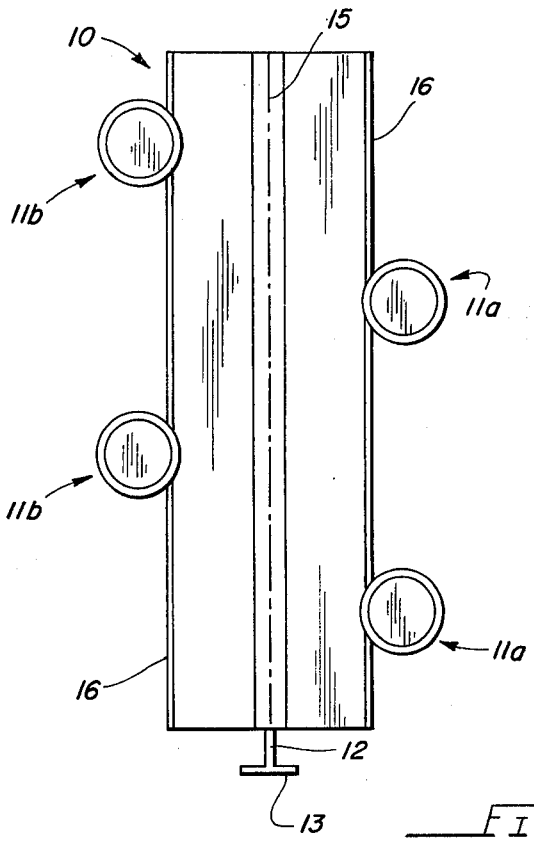
FIG. 1 is a front elevational view of a preferred embodiment of the target assembly of the invention.
Figure 6:
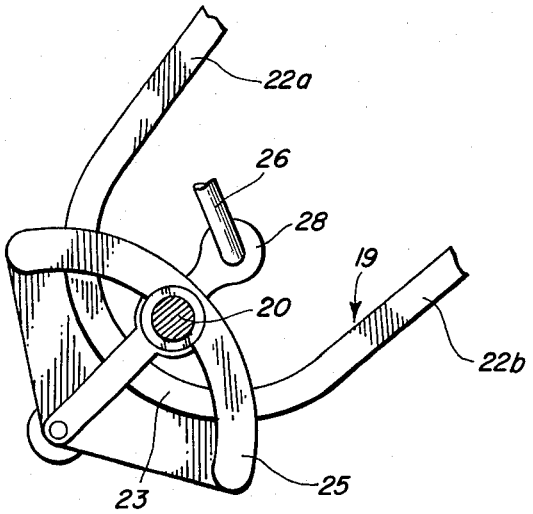
FIG. 6 is an enlarged fragmentary top plan view taken along the lines 6—6 of FIG. 5.
Figure 5:
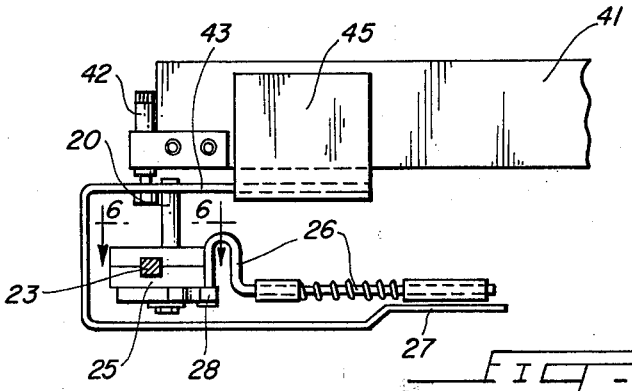
FIG. 5 is an enlarged, fragmentary side elevational view taken along the lines 5—5 of FIG. 2.
Figure 4:
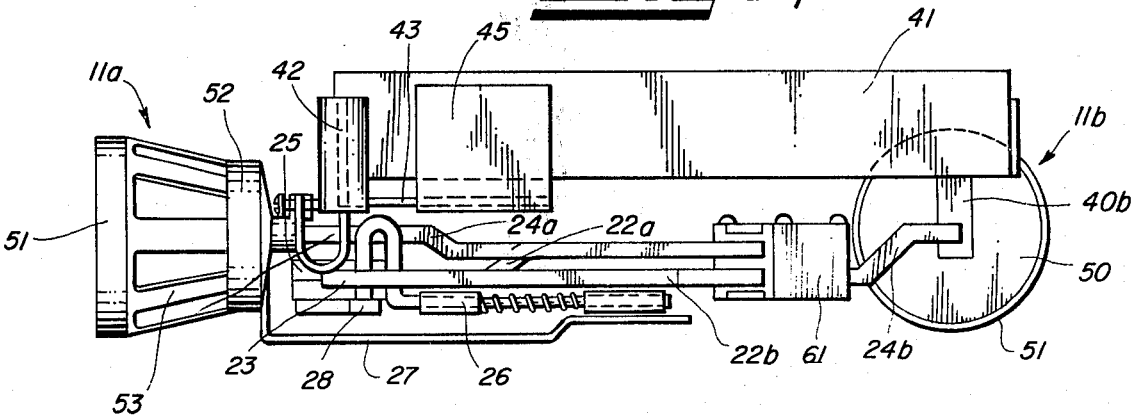
FIG. 4 is a fragmentary side elevational view of the target assembly, taken along the lines 4—4 of FIG. 2.
Figure 2:
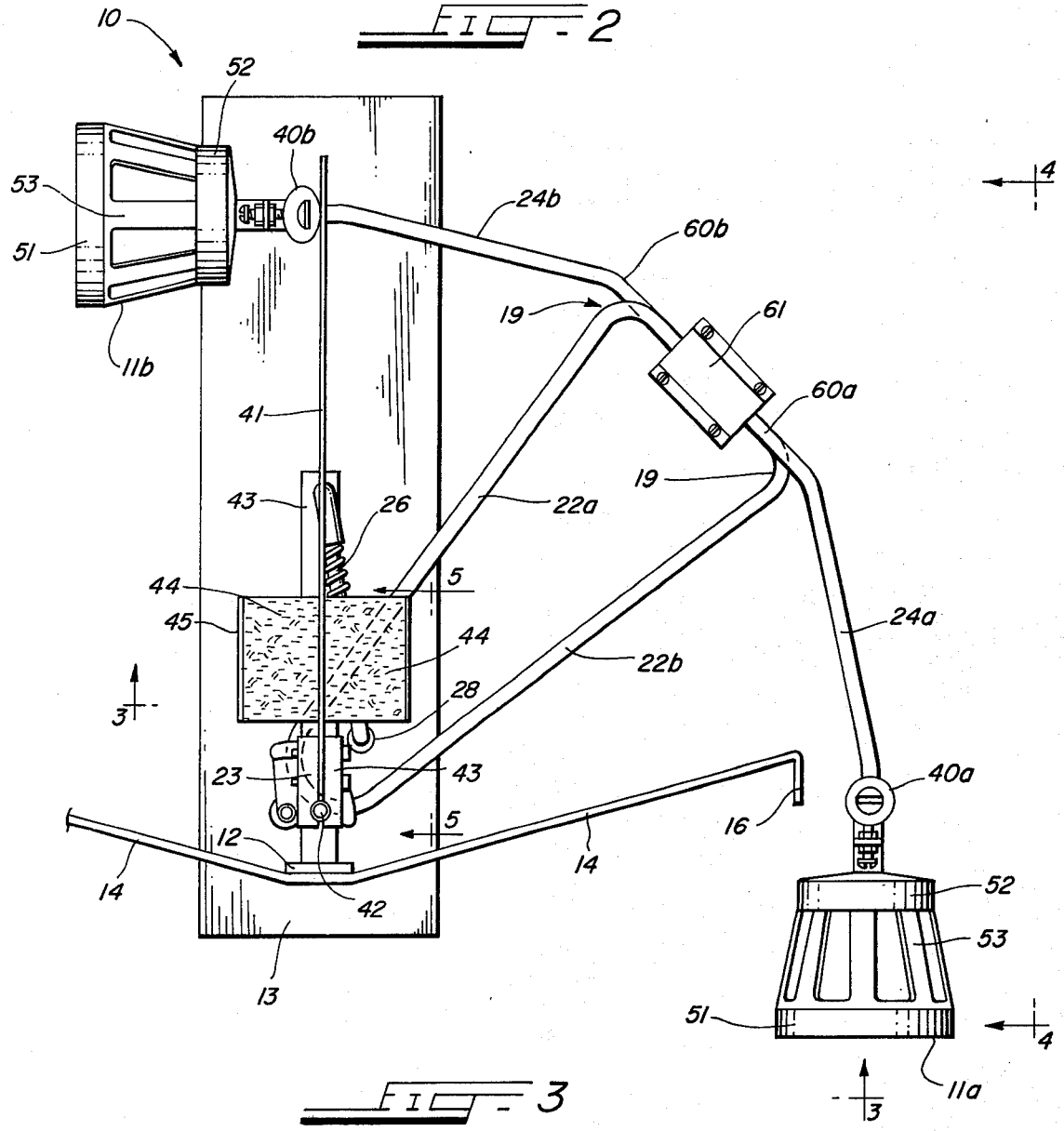
FIG. 2 is a top plan view of the target assembly shown in FIG. 1.

Referring now to FIGS. 1 and 2, the target assembly 10 of the invention includes four pairs of targets 11*a*, 11*b* mounted on a support standard 12 firmly affixed to a stable base 13. A protective shield 14 extends laterally outward from a center axis 15, exposing to view only a single target of each pair. Lateral marginal end portions 16 of the shield project forwardly, to preclude ricochet of missiles against the targets 11 or target arms 19 supporting the targets 11. When a target is struck by a missile, it shifts pivotally to an opposite lateral side of the shield 14.

In competitive use of the target assembly 10, two marksmen stand side by side at the same distance from the targets 11. Initially, two targets 11 are exposed on each side of the shield 14, as shown in FIG. 1. Each competing marksman attempts to impel missiles as rapidly as possible toward targets 11 on a side of the shield 14 assigned to him, with the objective of shifting all four exposed targets on to the opponent's side concurrently.

The target pairs 11 are mounted on arms 19 pivotally supported about a vertical axle 20, as shown in FIGS. 2–6. An axle support 21 fixes the axle 20 to the support standard 12. The arms 19 are integrally formed from a ¼ inch × ¼ inch aluminum bar and they each include a pair of pivot arms 22 bridged by an arcuate juncture 23, and a target support arm 24 forming an end extension of each pivot arm 22. Each target support arm 24 terminates in a circular hub 25 securing the target 11 to the arms 19.

A sector-like plastic collar 25 envelopes the arcuate juncture 23 and secures each arm 19 firmly to the axle 20. A toggle or bias spring 26 is compressed between a spring support arm 27 carried by the standard 12 and extending several inches rearwardly thereof, and a small plastic lip 28 joined to the plastic collar 25. This spring 26 tends to maintain the targets 11 relatively fixed in a first rest position, shown in FIG. 2. When a missile strikes an exposed first target 11*a* with a sufficient force to overcome the bias of spring 26, that target 11*a* will shift in an arcuate path to a second rest position out of view of the marksman. In this second rest position, a second target 11*b* is exposed to view, as exemplified by the uppermost target 11*b* shown in FIG. 1. The impact force of a missile required to overcome the bias of the spring 26 may be adjusted by varying the length of the spring support arm 27 or by using different types of springs.

In competitive shooting it is desirable that the targets 11 be as sensitive as possible to missile impacts so that they will shift position rapidly upon being struck. Therefore, the arms 19 and targets 11 are relatively light in weight and the biasing force of the spring 30 is small. However, these features also contribute to the possibility of rebound or bounce by the targets away from their rest positions after they have pivoted in response to missile impact.

To prevent such rebound, bounce or recoil, each target 11 is provided with a rearwardly facing foam rubber cushion 40 adapted to engage a laterally facing plate 41. This plate 41 is mounted pivotally on a vertical rod 42 supported by a support bar 43 extending behind the standard 12. The plate 41 is bounded on opposed lateral sides by a pair of elastic sponges 44 encased in a generally U-shaped, upwardly opening metal envelope 45 mounted on the support bar 43. When a cushion 40 strikes the plate 41, the plate pivots against one of the sponges 44 further to cushion shock of the missile impact. This prevents rebound of the cushion 41 away from the plate 40.

Figure 3:
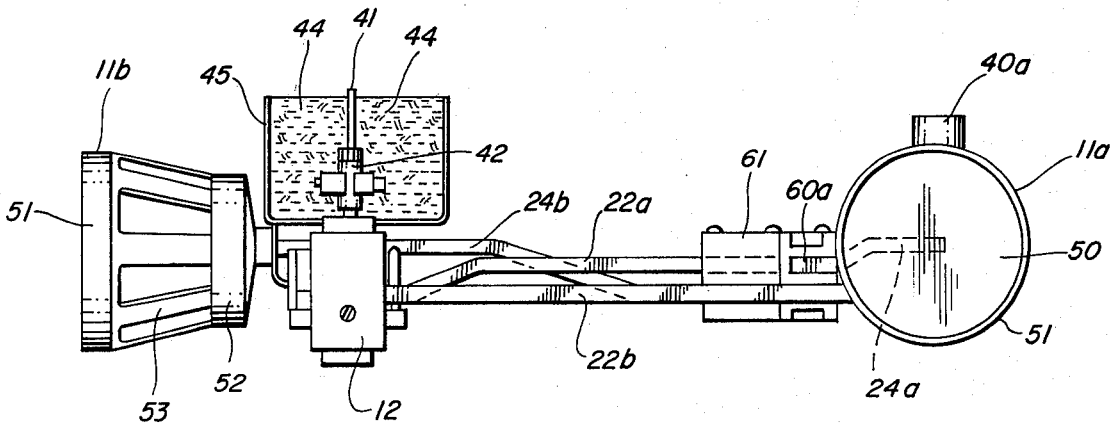
FIG. 3 is a fragmentary front elevational view of the target assembly, taken along the lines 3—3 of FIG. 2.

Structure of the unique shock-absorbing targets 11 of the invention is illustrated in FIGS. 2 and 3. Each target 11 includes a target face 50 surrounded by a narrow lip 51 projecting forwardly of the face 50. Each target 11 also includes a circular hub 52 mounted on a target support arm 24. Eight longitudinally resilient thin ribs 53 are secured around a marginal edge of the target 11 and extend rearwardly to join the hub 52. These eight ribs are molded integrally with the target face 50 and lip 51, and they cushion missile impacts without need for any accessory shock-absorbing structures such as springs or sponges.

As shown in FIG. 2, the target arms 19 are bent reversely to overlap one another in two short parallel sections 60*a*, 60*b*. A sleeve 61 affixed to one of these sections 60*a* circumscribes a corresponding section 60*b* of the second target support arm 24*b*. This sleeve 61 ensures concordant movement of the respective support arms 24*a*, 24*b*, and it also limits lateral, scissors-like movement of the arms 19 after a cushion 40 strikes the pivot plate 41.

Numerous equivalents of the preferred embodiment described above will occur to persons skilled in the art, without departing from the scope and spirit of the following claims. This invention has been described with reference to a preferred embodiment, and no unnecessary limitations should be understood therefrom.

What is claimed is:

1. In a target assembly including a target support standard, first and second targets, arm means pivotally supporting each of said targets on said standard, means interconnecting said arm means with one another to ensure concordant movement therebetween, and biasing means for holding said arm means relatively fixed in each of a first and second rest position, in each of which rest positions a face of one of said targets is presented to the view of a marksman, said arm means being shiftable through an arc about said standard and being responsive to the force of a missile striking one of said targets to overcome said biasing means and to pivot about said standard between the first rest position and the second rest position;

the improvement comprising damping means to preclude rebound of said arm means from a new rest position assumed when a missile strikes a target, said damping means comprising a cushion carried by each said arm means and directed rearwardly of said targets; and a cushion-engaging plate disposed rearwardly of said target support standard and in a line of movement of said cushion, said plate being adapted to engage said cushion upon pivotal shifting of said arm means about said standard.

2. The improvement as set forth in claim 1, wherein said plate is pivotally mounted on said target support standard, and wherein said damping means further comprises laterally resilient plastic means adjacent said plate on opposed lateral sides thereof, thereby to damp movement of said plate upon engagement of either of said cushions therewith.

3. The improvement as set forth in claim 1, wherein said biasing means comprises a toggle spring affixed to and supported by said standard.

4. The improvement as set forth in claim 1, wherein said arm means comprises first and second pivot arms pivotally supported by the target support standard, and first and second target support arms intersecting with and joined to respective said pivot arms, said target support arms each including a section generally parallel with and adjacent to a corresponding section of the other of said target support arms;

and wherein said target assembly further comprises a sleeve affixed to a first target support arm and circumscribing an adjacent, parallel section of a second target support arm, said sleeve being adapted to abut against the second pivot arm upon rapid shifting of said arms means to engage either of said cushions with said plate, thereby limiting lateral movement of said first pivot arm.

5. The improvement as set forth in Claim 4, wherein said first and second pivot arms and said first and second target support arms are integrally formed from a single metal bar.

6. In a target assembly including a target support standard, first and second targets, arm means pivotally supporting each of said targets on said standard, shock absorber means interposed between and connecting each said targets to said arm means to cushion the impact of a missile striking said targets, means interconnecting said arm means with one another to ensure concordant movement therebetween, biasing means for holding said arm means relatively fixed in each of a first and second rest position, in each of which rest positions a face of one of said targets is presented to the view of a marksman, said arm means being shiftable through an arc about said standard and being responsive to the force of a missile striking one of said targets to overcome said biasing means and to pivot about said standard between the first rest position and the second rest position, damping means to preclude rebound of said arm means from a new rest position assumed when a missile strikes a target, said damping means comprising a cushion carried by each said arm means and directed rearwardly of said targets, and a cushion-engaging plate disposed rearwardly of said target support standard and in a line of movement of said cushion, said plate being adapted to engage said cushion upon pivotal shifting of said arm means about said standard;

the improvement wherein said shock absorber means comprises a plurality of annularly spaced, longitudinally resilient ribs secured circumferentially around a marginal edge of said target, said ribs terminating in hub means securing rearwardly directed posterior ends of said ribs to said arm means.

7. The improvement as set forth in claim 6, wherein said target assembly further comprises a narrow lip circumscribing said target and extending forwardly thereof.

8. The improvement as set forth in claim 7, wherein said target, said ribs, and said lip are integrally formed from a thermoplastic substance.

9. The improvement as set forth in claim 6, wherein said target is generally circular and said hub means includes a generally circular disc having a diameter less than the diameter of said target.

10. The improvement as set forth in claim 6, wherein said target includes a target face, and wherein said ribs are displaced symmetrically about an axis normal to said target face.

* * * * *